US005610350A

United States Patent [19]

Miller

[11] Patent Number: 5,610,350

[45] Date of Patent: Mar. 11, 1997

[54] VARIABLE PITCH DRUM

[76] Inventor: Bradford W. H. Miller, Rte. 1, Box 187, Spencer, W. Va. 25276

[21] Appl. No.: 57,602

[22] Filed: May 5, 1993

[51] Int. Cl.[6] ..... G10D 13/02

[52] U.S. Cl. ..... 84/413

[58] Field of Search ..... 84/413, 421, 411 R, 84/419

[56] References Cited

U.S. PATENT DOCUMENTS

| | | | |
|---|---|---|---|
| 355,057 | 12/1886 | Buchanan | 84/413 |
| 955,736 | 4/1910 | Yates | 84/413 |
| 2,495,450 | 1/1950 | Gladstone | 84/413 |
| 3,185,013 | 5/1965 | Gussak | 84/413 |
| 3,685,389 | 8/1972 | Bemben | 84/411 R |
| 4,228,721 | 10/1980 | Hancox | 84/411 R |
| 5,157,212 | 10/1992 | Fleming | 84/413 |

*Primary Examiner*—Cassandra C. Spyrou
*Attorney, Agent, or Firm*—Jim Zegeer, Esq.

[57] ABSTRACT

A variable pitch percussion instrument comprising a drum body having an open end with an annular edge, and at least one drumhead assembly, including, flexible drumhead material stretched across the open end and an annular drumhead mounting ring secured to the perimetrical edges of the flexible drumhead so that tension can be increased on the drumhead by pressure between the open end of the drum body and the head. A plurality of flexible linear connecting elements, each having a pair of ends has one end of each of the flexible linear elements circumferentially around the mounting ring and the other ends, respectively, the other end of the drum body. A flexible tuning element located between the ends of the connecting elements, respectively, and arranged to tangentially engage and circumferentially wrap around the connecting elements such that when the area enclosed by the flexible tuning element is varied it causes the connecting elements to apply more or less tension on the drumhead material and change the pitch when the drumhead is vibrated. The drum body is mounted on a floor stand and a foot pedal mechanism is included to actuate the tuning element.

11 Claims, 8 Drawing Sheets

VARIABLE PITCH DRUM

BACKGROUND OF THE INVENTION

My invention is a musical instrument based on the traditional African drum known as a "Dondo". This type of variable pitch drum is often referred to in the United States as a "talking drum", because of the ability to alter its tonal pitch rapidly.

The Dondo has an hourglass-shaped wooden body carved from a wooden log. Circles of goat or lizard skin are stretched over each end and form the vibrating surfaces, or heads, of the drum. Leather or rope lacing is threaded through holes in the edges of the skins, back and forth from one skin to the other, to draw the skins uniformly over the ends of the drum body and tension them. The lacing is continued, around the drum body until the starting end of the lacing can be tied to the other end. To play the drum, it is placed between its player's arm and body, with the arm holding it near the center of the drum body. By pressing the arm toward the body, the lacing is squeezed toward the central, narrowest part of the drum body. This increases the tension of the lacing on the drumheads. The drum is beaten, typically, with a stick in one hand, and with the other bare hand. Squeezing the drum between arm and body changes the drum-head tension, and hence the drum's pitch. This creates the wide and interesting range of sounds which gives this class of drum the nickname "talking drum."

There are some major problems with the "Dondo", when used by contemporary professional drummers or percussionists.

Environmental factors, principally humidity and temperature acting on the animal skins and leather or rope, directly effect tension in the drum heads. The results are sound quality changes and changes in the drum's response to its player's actions. This creates artistic problems for the musician.

Animal-skin drumheads are easily broken. Because of the continuous nature of the lacing, proper replacement requires removal of both drum heads, and complete replacement of the lacing. The repair operation can require a day's time.

Since it is intended to be held under the player's arm, such a drum is limited to relatively small overall size and modest weights, consequently to a relatively high range of pitch. Because the little drum must be carefully held and squeezed, it renders difficult the effective playing of other types of drums and percussion instruments.

Earlier U.S. Patents in variable pitch drum art have emphasized low cost drums related to the Dondo pattern. Craig Woodson, in U.S. Pat. No. 4,077,297, describes a Variable Pitch Drum which is laced by a "cord" in the same zigzag pattern marking the Dondo design, and altered in pitch in the same manner, "by manually squeezing the cord toward the drum shell, which in that case is a cardboard tube.

U.S. Pat. No. 2,204,987, issued to W. Gussak, describes an instrument with body narrowed at its center. The Gussak patent is limited to the original manner of operation, discloses a "hoop member" for supporting the skin. The specification (p. 1, col. 2, lines 30–36) mentions, but does not appear to further describe, a proposal ". . . to tension the drum heads by means of a foot pedal and spring arrangement." Gussak discounts that possibility, indicating that "such an arrangement does not give the player the "feel of the instrument to enable him to produce the great variety of tones that can be produced by the instant invention."

A later patent issued to the same inventor (U.S. Pat. No. 3,185,013) added a pair of spring-mounted concave pads on each side of the drum at its center whose purpose is to aid in gripping the drum. These additional elements do not control lacing tension and pitch.

Gussak's object (p. 1, lines 20–24) was a small and cheap instrument, and large drums using this tuning principle, nor did his invention incorporate means to overcome the temperature and humidity variability of the original instrument.

BRIEF DESCRIPTION OF THE INVENTION

My invention is a novel drum embodying the same basic mechanical and acoustical principles embodied in making the Dondo a variable pitch drum, but improving on the Dondo. There follows a description of a preferred embodiment of the invention.

According to the invention, one or two drum heads are provided with a plurality of circumferentially spaced cables constituting a cable set. In the preferred embodiment of two drum heads, the two ends of each cable in a cable set is coupled to a drum head, respectively. Each cable has a grooved pulley or roller proximate the center thereof and a flexible linear tuning cable is wrapped around the drum body via the grooves on each pulley or roller, and by drawing on one or preferably both ends of the flexible linear tuning cable the effective diameter thereof is reduced to thereby exert a uniform force circumferentially around the drum heads and vary the pitch. In the preferred embodiment, a semi-rigid actuating cable or rod enclosed by a flexible metal tube is coupled to a foot pedal mechanism so that the tuning cable can be operated by a foot pedal. Alternatively, to adjust the drum pitch on a fixed basis, a simple screw and knob threadably engaged with a fixed threaded bore has the ends of the tuning cable connected thereto so that simply by rotating the knob the tuning cable is shortened (higher pitch) or lengthened (reduced pitch) to vary the drum pitch, or the foot pedal can have discrete latchable or lockable positions.

In my invention, the animal skin drumheads are preferably replaced by heads of Mylar sheet, which has now become a standard material for conventional band or orchestral drums. With this head material, combined with my tensioning and tuning mechanisms, drum pitch is almost independent of temperature or humidity. The mylar drum heads are mounted in round hoops, as used in most modern professional drums. Drum heads can be replaced without major disassembly of the drum.

My invention enables making "talking drums" which are well beyond the size and pitch limits imposed by the traditional Dondo. Using my invention, drums with head diameters from 6" to 20" or more are practical. Because of the way the drum is mounted and played, its size and weight are no longer problems to the player. Furthermore, a drum built according to my invention can be varied in pitch while leaving use of both arms and hands free to play it and other drums with sticks, or the pitch can be easily and quickly adjusted. This drum will appeal to professional trap drummers and other percussionists desiring a variable pitch drum to add to their percussion instrumental setups. This drum is quickly and easily set up and taken down, adjusted. Replacement of a broken head can be done quickly, just as with other modern drums. Thus, drums constructed according to my invention meet needs of contemporary percussionists. Moreover, my invention is intended for the contemporary percussionist who is often required to play several instruments in rapid succession whereas the dondo cannot be played with other instruments in P succession.

Rather than using lacings of leather or rope, in a preferred embodiment of my invention the drum-head hoop(s) are connected by a set of metal cables, each joining a point on one hoop with the corresponding point on the opposite hoop or anchor member. Rather than holding the drum between the player's arm and body, the drum is preferably supported, like other modern drums, by its own floor stand. Moreover, rather than pressing the arm toward the body, the stressing of the heads to alter pitch is brought about by a foot operated lever or pedal as described above, freeing both hands to play the drum or other drums.

When the foot pedal is pressed, an extension of the inner cable pulls on a mechanism which squeezes the cables connecting the drumheads inward towards the axis of the drum. This increases tension on the drum hoops, thus stretching the drum heads and changing the pitch of the drum. A latch mechanism can be engaged to maintain the tension at a fixed level so the pitch of the drum will be maintained constant at that level.

DETAILED DESCRIPTION

Figure 1:
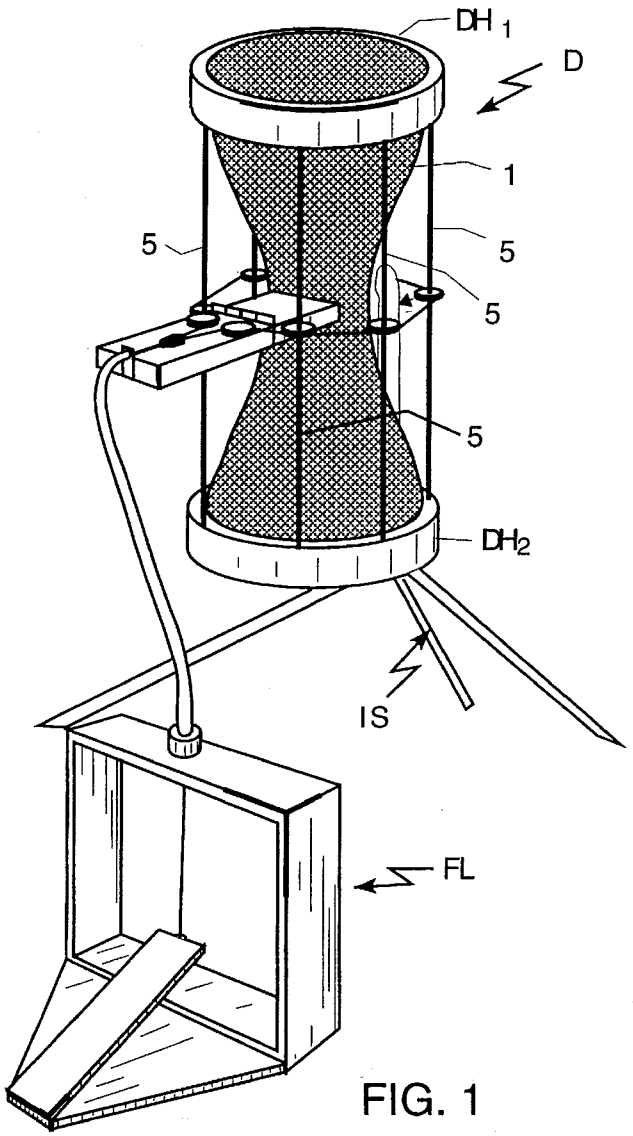
FIG. 1 is a perspective view of a drum incorporating the invention.

The figures illustrate preferred embodiments of my invention As shown in FIG. 1, it is comprised of four major parts: (a) the drum D proper including drumheads DH1, DH2, and the cables which connect the two heads; (b) a detachable instrument stand IS of conventional design, attached to the drum body through a bracket rigidly affixed to the drum body, (c) a tuning mechanism attached to the center of the drum body, and (d) a foot lever FL actuator and flexible cable connected to the tuning mechanism (which may be replaced by hand actuators such as shown in FIG. 3*b*). The novelty in my invention lies principally in the pitch-changing mechanism and its connection to the drumheads, and the way in which the various elements of the drum are arranged. While the drum illustrated is a "dondo" type, the invention is applicable to adjust pitch in all types of drums.

Figure 2:
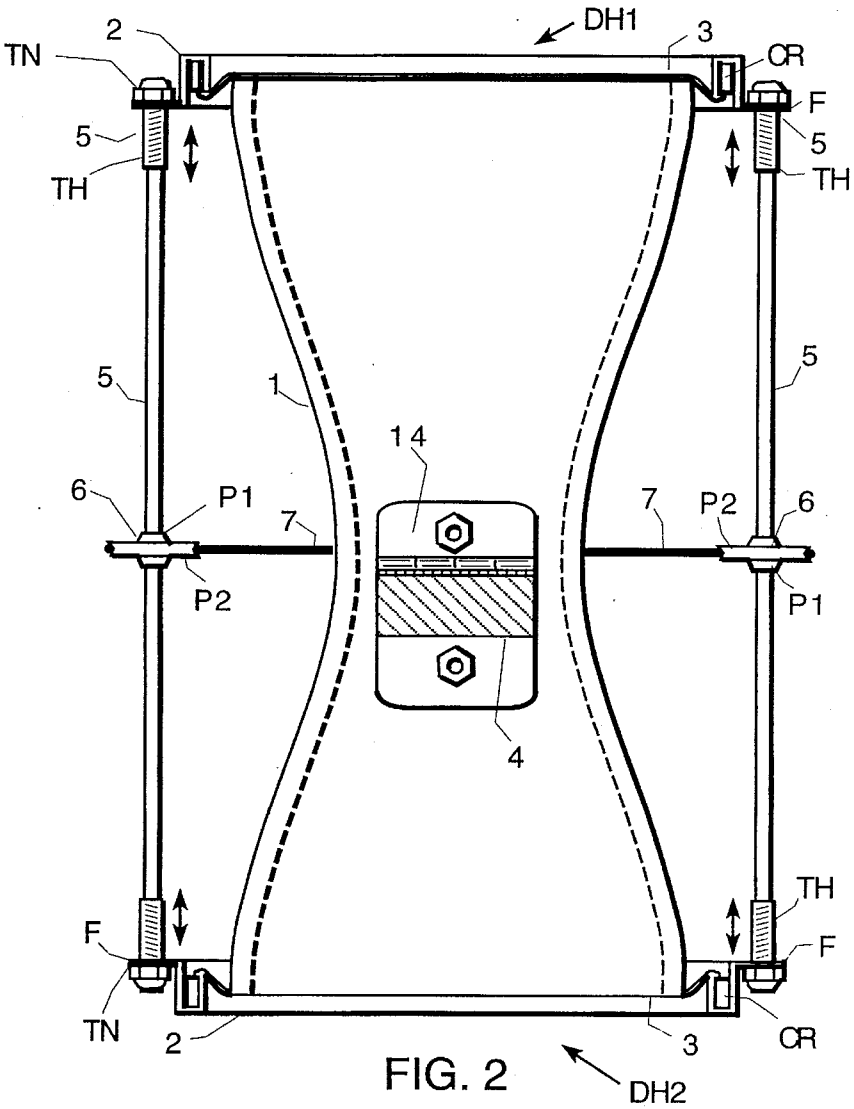
FIG. 2 is a side view, with some parts in cross section, of the drum proper, in a preferred embodiment of my invention.

FIG. 2 is a modified cross-section the drum proper, which comprises drum body 1, upper and lower drumheads DH1, DH2, each having drumhead hoops 2 (shown in cross-section) which incorporate conventional clamping ring CR means to constrain modern mylar drumheads 3, and linear connecting cables 5 terminated at each end by a threaded rod TH which extends through a flange F on hoop 2 and is held in place by a threaded nut TN. The plurality of connecting cables 5 is spaced, preferably uniformly, around the cylindrical periphery of the drum body 1. Pulleys 6 and flexible linear tuning cable 7 are parts of the tuning mechanism, which will be explained below principally through reference to FIGS. 3 and 5. Element 4 is the fixed part or mounting bracket for part of the tuning mechanism, shown at its point of attachment (either by adhesives or discrete fasteners) to the body 1 of the drum D, just below its center.

Figure 3A:
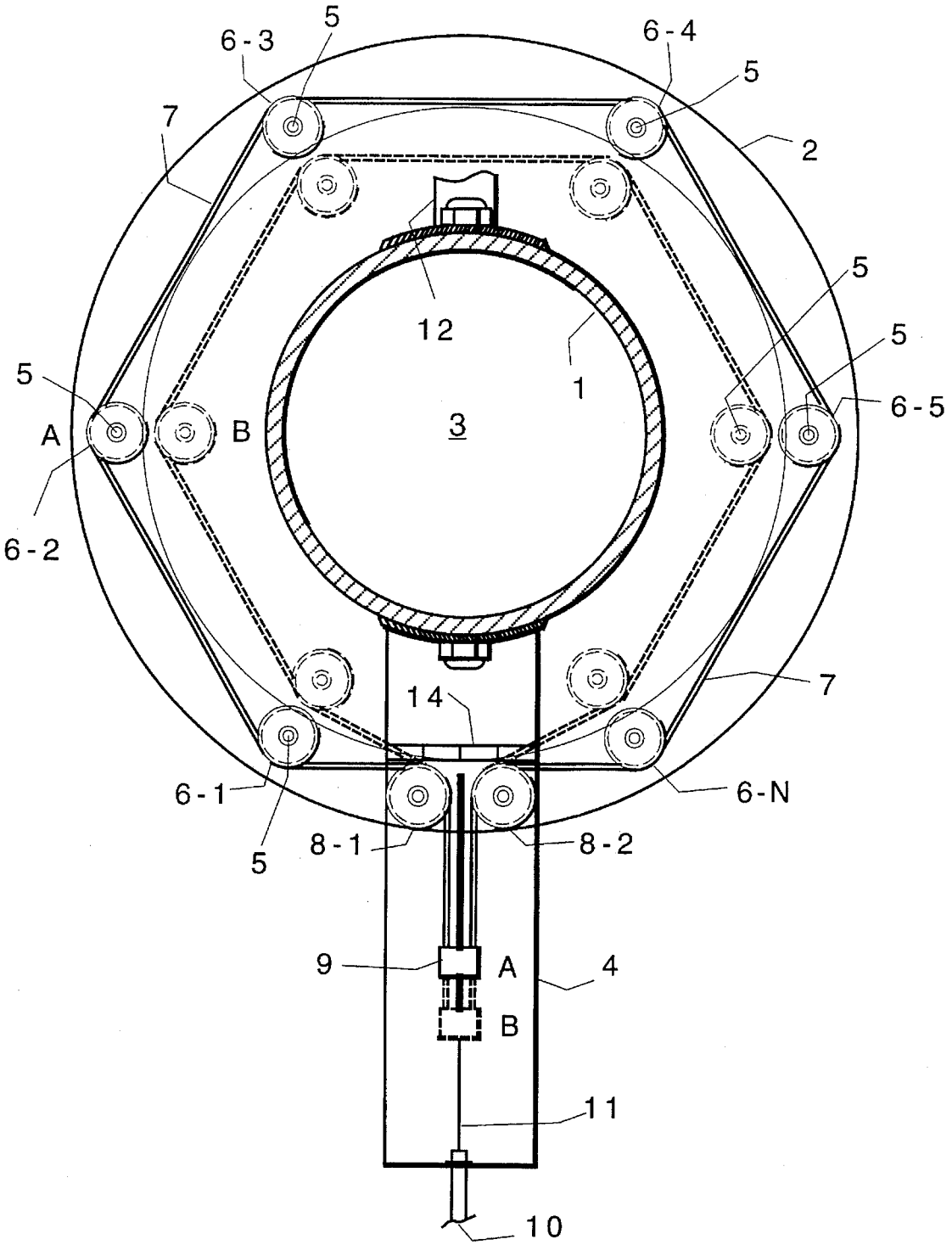
FIG. 3*a* is a top view of the drum proper, with the upper head and top part of the body cut away to show a plan view of the tuning mechanism.
Figure 3B:
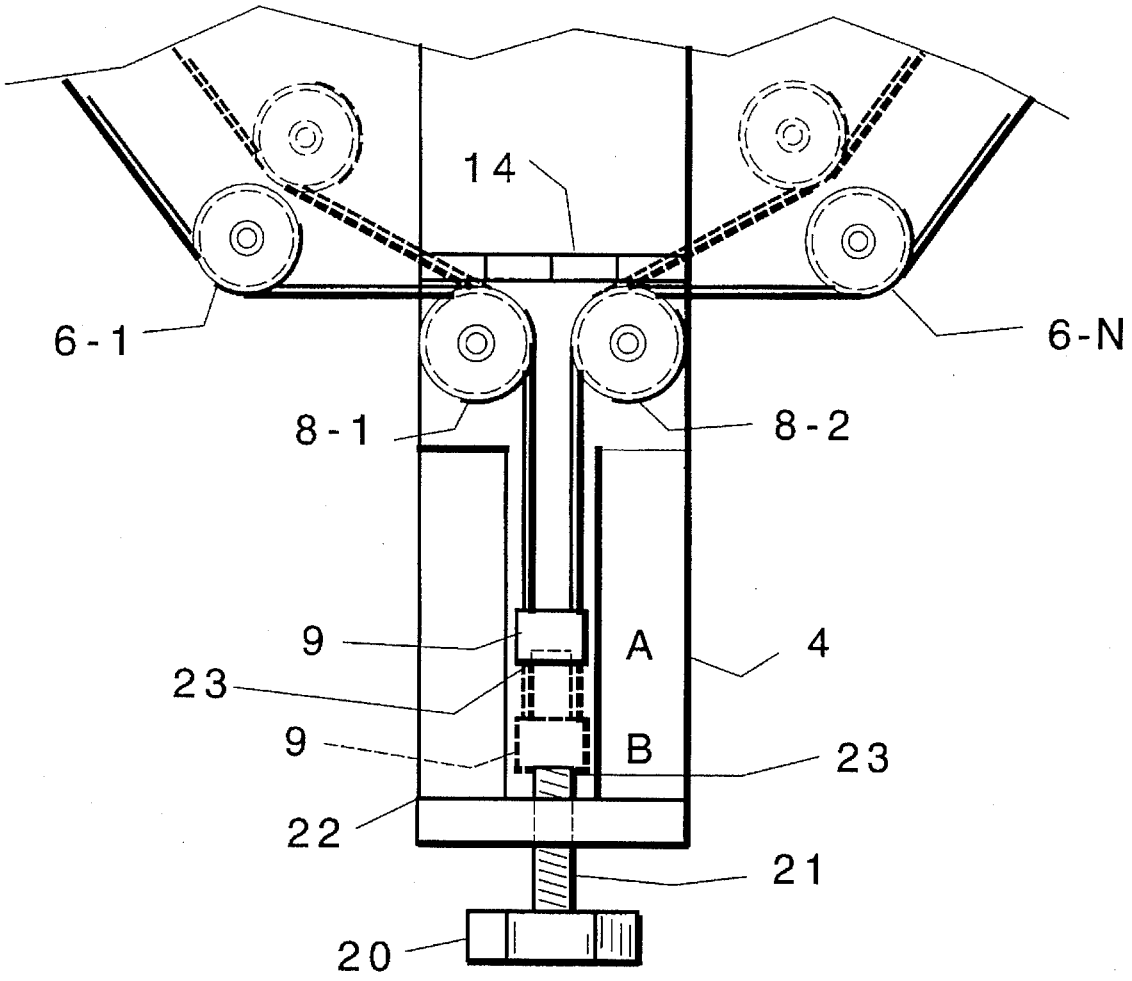
FIG. 3*b* is a partial view similar to FIG. 3*a*, but showing a screw knob actuator instead of a foot pedal.

FIG. 3*a* is a cutaway view looking down on the axis of the drum, with the upper body and hoop not shown, to best depict the design and operation of the tuning mechanism. The drum body 1, shown at its smallest, central, cross section. The outer periphery of the lower hoop is shown at 2, while 3 represents the drumhead percussion material, which span most of the diameter of the drum. The head-connecting cables 5, viewed end-on, are at the centers of pulleys or rollers 6. The mounting bracket 4 of the tuning mechanism is shown fixed to the drum by a metal bracket and bolt, and has mounted on it two pulleys or rollers 8-1, 8-2, which may be similar to pulleys 6. Clamp 9 restrains the two ends of tuning cable 7. From clamp 9, a tensioning cable 7 passes first over one fixed pulley 8-1, then over each of the pulleys 6 suspended on connecting cables 5, over a second fixed pulley 8-2 and finally back to clamp 9. At the opposite end of clamp 9 is connected the core wire 11 of actuating cable 10, whose outer tube is clamped to the fixed part or mounting bracket 4 of the tuning mechanism.

Figure 3C:
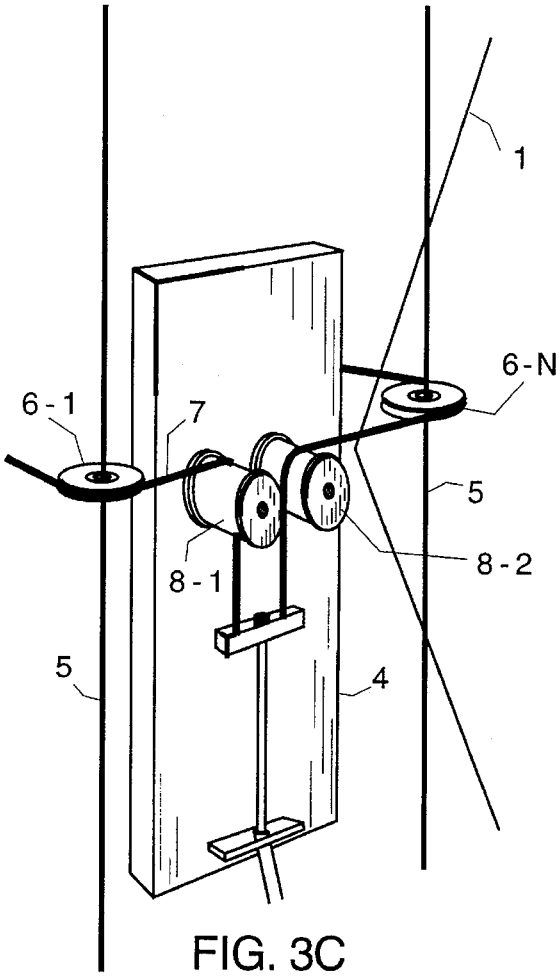
FIG. 3*c* illustrates a further modification.

In FIG. 3*c*, the bracket 4 is vertically oriented with the ends of tuning cable 7 trained over pulleys 8-1 and 8-2 so that the final end positions of cable 7 can be running parallel with the vertical axis or at any desired angle.

Figure 4A:
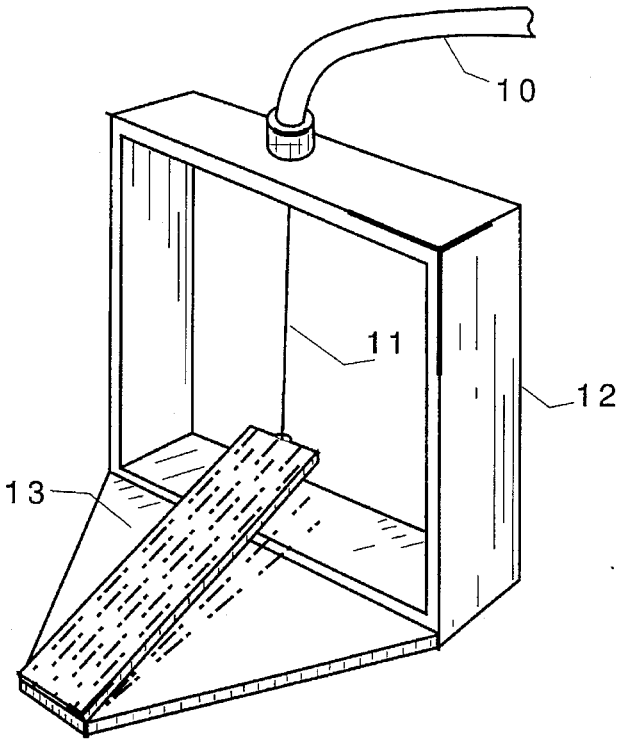
FIG. 4*a* is a view of a foot pedal control suitable for changing the pitch of the drum.

FIG. 4 depicts a representative pedal control, whose frame 12 rests on the floor and supports pedal 13, hinged at its low end. Actuating cable 10 is clamped to the frame of the control, with its core wire 11 attached to the pedal. A return spring is not normally needed on the pedal, since drumheads 3, through connecting cables 5 and tuning cable 7, resist downward force on the pedal and return the drumhead to its lowest frequency. However, if the actuator cable has significant friction, an additional spring may be used at the foot pedal to ensure that the drumheads are stressed only by connecting cables 5 when the pedal is not being pressed. The foot pedal and power cable are designed for the smoothest and fastest transmission of power from the foot pedal to the variable pitch mechanism and back again to the foot pedal. The low i foot pedal and cable mechanism operates smoothly and quickly, allowing an "action" that can create special and unusual effects in sound.

Figure 4B:
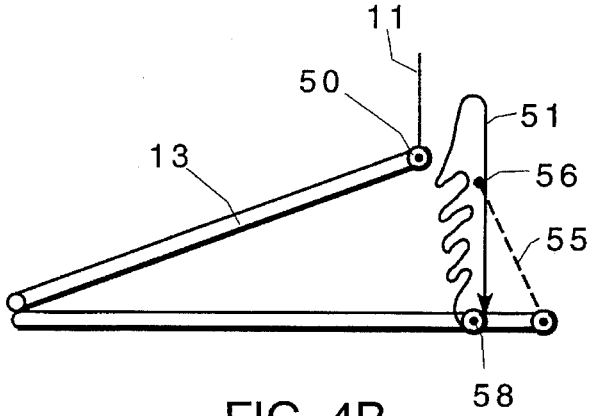
FIG. 4*b* illustrates a stepped latch modification for the foot pedal.

In some cases the musician may wish to quickly adjust the pitch in discrete steps, or adjust the pitch for one musical rendition and then shift to another predetermined pitch. FIG. 4*b* shows an adjustable multi-position fast pedal lock to hold or set the drum at pre-adjusted pitches. An outer portion of the foot pedal 13 includes a roller 50 which engages and cams notched latch 51. A spring 52 biases the latch 51 to engagement with roller 50 to thereby maintain a given pitch adjustment until released. A hook 55 (shown dotted) engages hole 56 to disengage and disable the latch 51 and enable the pitch.

Figure 5:
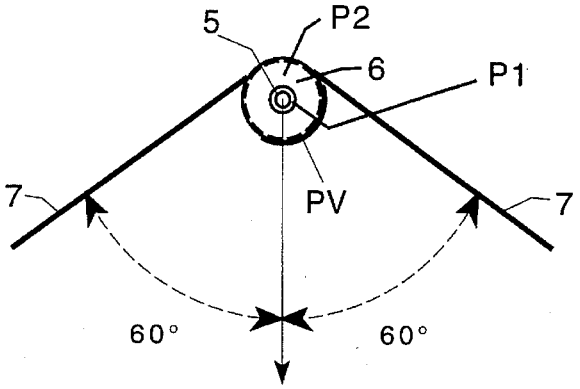
FIG. 5 illustrates the geometry of the forces applied to tension the cables which connect the two heads of the drum and ensure a consistent and uniform tensioning of the heads.
Figure 8A:
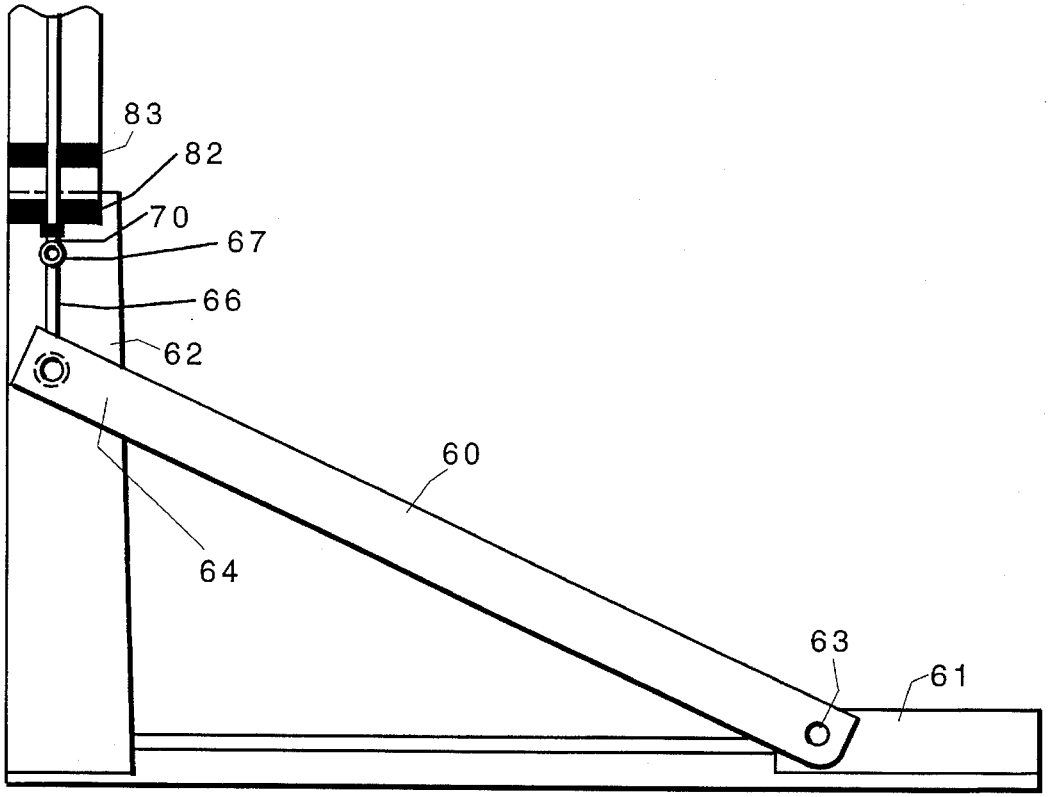
FIGS. 8*a* is a side elevational view of a preferred embodiment of the foot pedal mechanism.
Figure 8B:
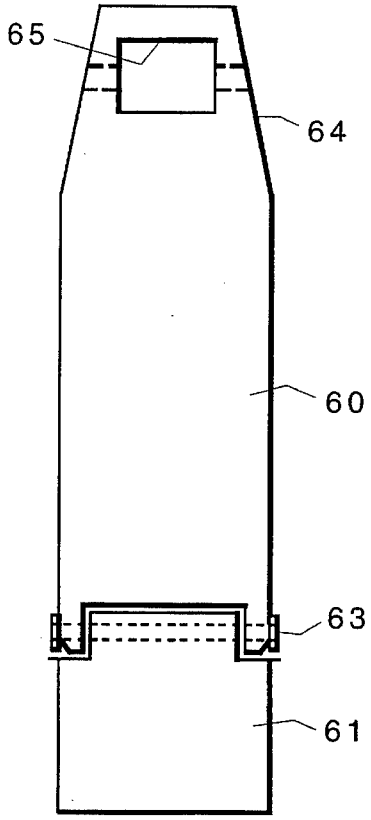
FIG. 8*b* is a top view of the foot pedal.
Figure 8C:
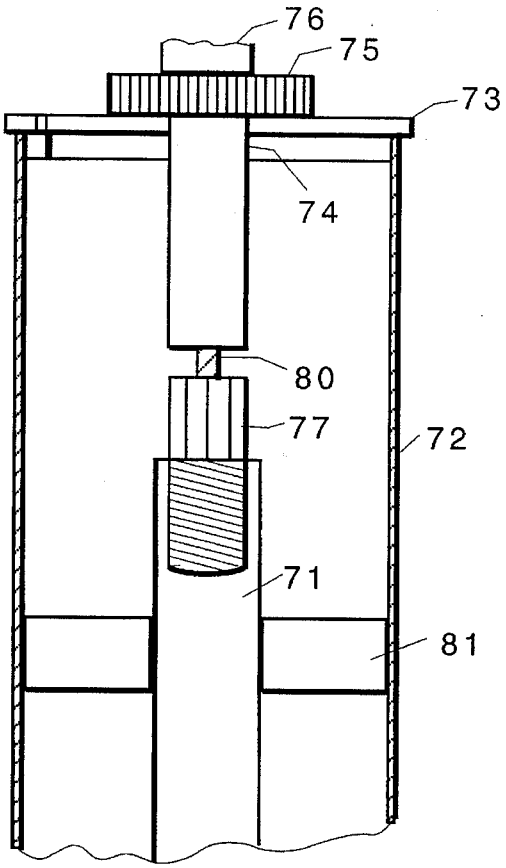
FIG. 8*c* is an enlarged sectional view of coupling for the foot pedal actuator.
Figure 8D:
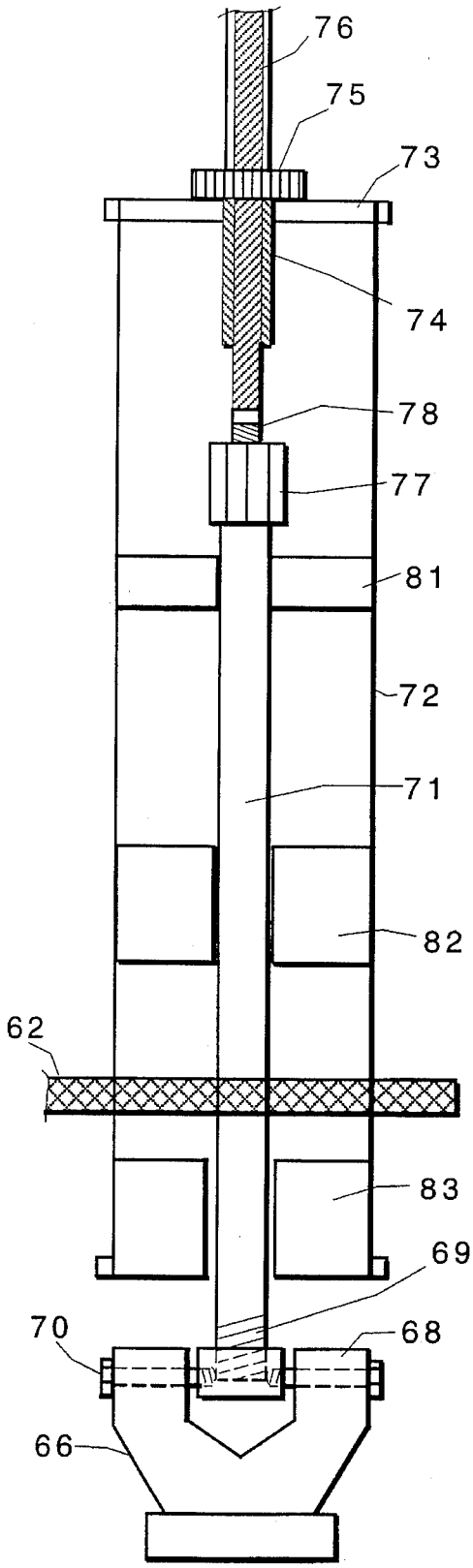
FIG. 8*d* is a sectional view of the linkage from the foot pedal to the motion transfer cable.
Figure 8E:
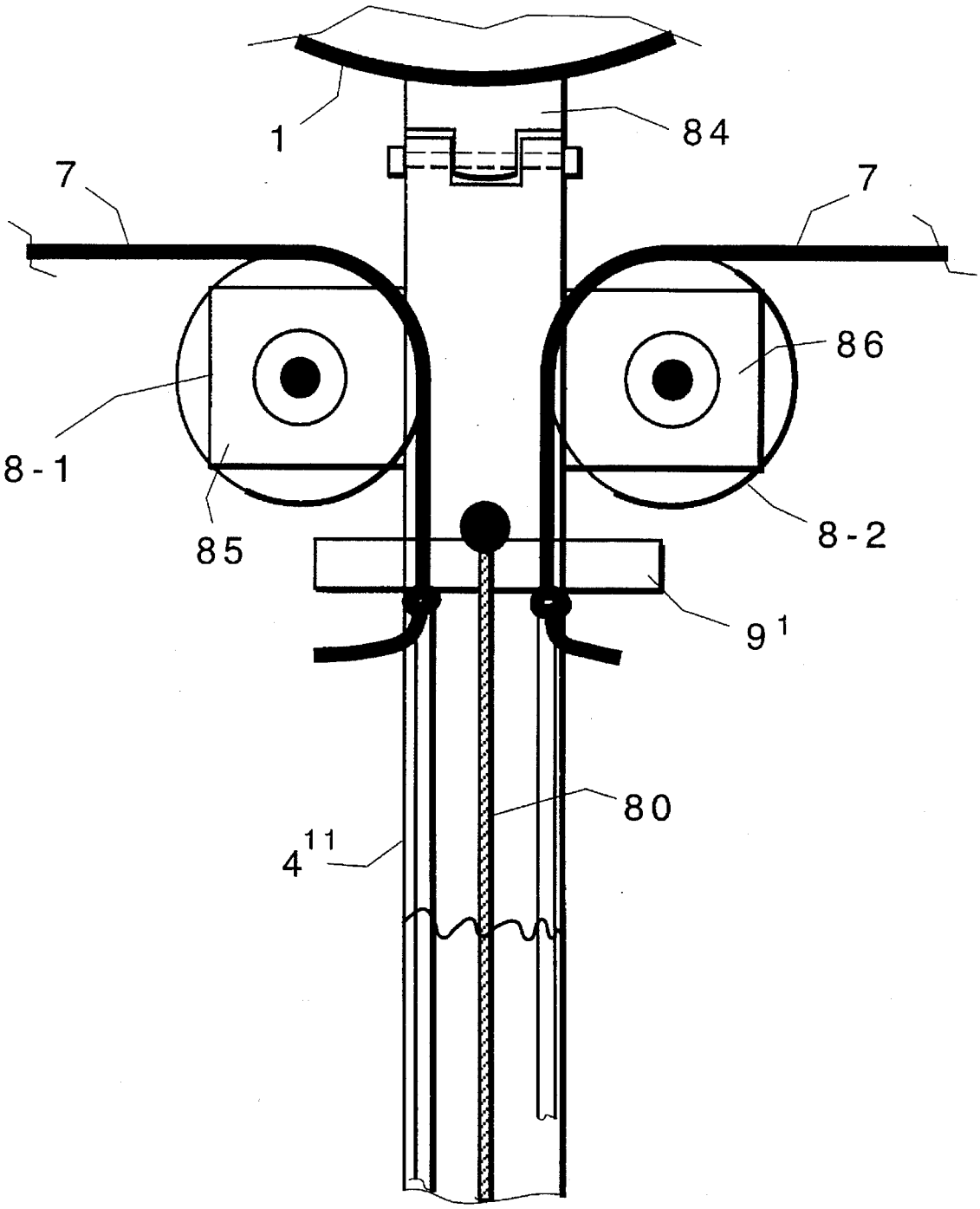
FIG. 8*e* illustrates the connection of the motion transfer cable to the turning cable.

FIG. 5 illustrates an important feature of the tuning mechanism which ensures uniform stretching of the drumhead and, in consequence, consistent tonal quality from the instrument. Tuning cable 7 passes over each pulley 6 in the same uniform way. Each pulley has a first or fixed part P1, which is secured or fixed to the connecting cable and a rotary portion P2 journaled for rotation on low friction bearings (not shown) in the fixed part P1. The direction of the force on each cable can be found by bisecting the angle of tuning cable 7, as it passes over a pulley 6. The geometry ensures that, except for the two pulleys 6 which are closest to fixed pulleys 8-1, 8-2, the direction of the force on each pulley is exactly toward the center of the drum. The forces on the pulleys 6 closest to fixed pulleys 8-1 and 8-2 will be slightly in error. To illustrate this, FIG. 3*a* shows both at-rest locations of the pulleys and cables, and their positions with exaggerated motion. In practice, mylar heads 3 and metal connecting cables 5 deform little over the useful range of tensioning, hence the change in geometry is less than that shown. The change in geometry could be further reduced by employing a more complex mechanical arrangement to ensure that the two sections of cable 7 joining pulleys 8 with closest pulleys 6 remain collinear over the drum's tuning range. In this application, the additional refinement is not required.

In the modification shown in FIG. 3*b*, instead of a foot pedal, a simple tuning knob 20 is provided on the end of screw or threaded shaft 21 which is threadably engaged with threaded block 22 which is fixed to mounting bracket or fixed part 4. The end 23 of screw shaft 21 is rotatably coupled to clamp 9 so that merely rotating tuning knob 20 causes clamp 9 which may be in a guide track 24 or guided by a guide rod (not shown). Instead of being threadably engaged with block 22, clamp 9 could have a threaded bore engaged with threaded shaft 21 which passes through an journal aperture in block 22.

Figure 6:
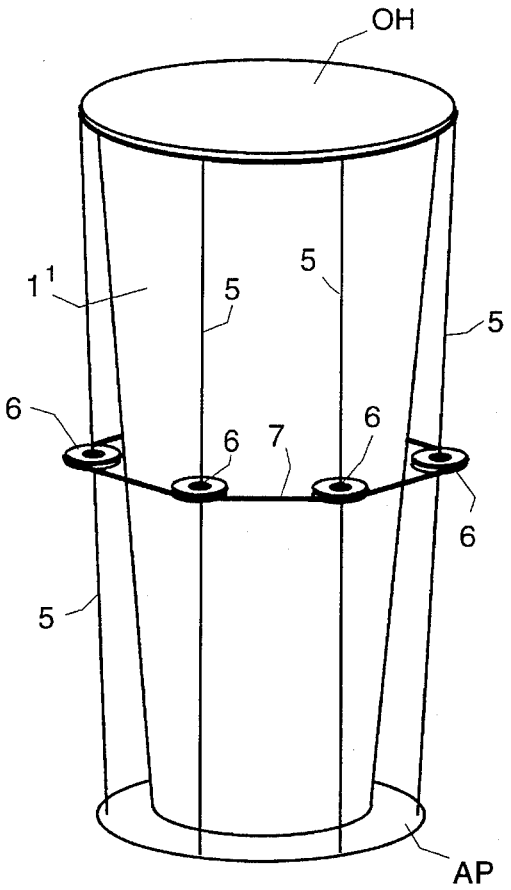
FIG. 6 illustrates a modification of the drum body.

In FIG. 6, the drum body is a long cone or conical (Ashiko), it being appreciated that other drum body shapes can be used. In FIG. 6, the drum has one drum head DH and an anchor plate AP for the lower ends of tuning cables 5.

Figure 7:
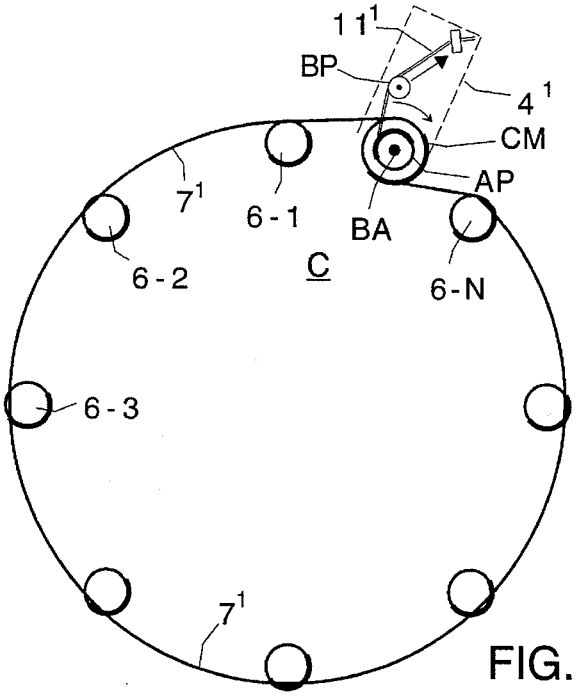
FIG. 7 illustrates a modification incorporating a cam.

FIG. 7 illustrates a further modification. In this embodiment, the ends of the pulley gathering or tuning cable 7' are secured to diametrically opposing points on the periphery of cam member CM which is rotatably mounted on bracket 4' by cam bearing axle CBA. Actuating cable 11' from the foot pedal actuator is guided by bracket pulley BP, trained around actuating drum AD portion of cam member CM. Actuation of the foot pedal and actuating cable 11' rotates cam member in a clockwise direction (in FIG. 7) to effectively gather in and shorten the tuning cable 7' and thereby tighten the drum heads and change the pitch of the drum.

FIGS. 8*a*–8*e* illustrate a preferred embodiment of the foot pedal mechanism which provides smooth and instantaneous transmission of foot pedal motion to the variable pitch mechanism and back again. Foot pedal 60 is pivotally coupled to the base 61 of the foot pedal frame support 62 by a pivot pin 63. The opposite end 64 includes a clevis or yoke 65 for hingedly receiving the lower end of a coupling link 66 via a hinge pin 67. The upper end of link 66 includes a clevis or yoke 68, which has arms straddling the lower end of connector 69 and is pivotally coupled thereto by hinge pin 70. Connector 69 has a threaded bore for receiving the lower end of motion transmitting steel rod 71. Motion transmitting rod 71 is mounted in a steel tube or housing 72, the lower end of which is secured to pedal frame support 62 and the upper end is closed by cap member 73. Cap member 73 has a threaded bore 74 for receiving the threaded end of a cable sheath adjuster 75 which is secured to the end of cable sheath 76. This adjustment is similar to that found on bicycle brake cables and the like.

Motion transmitting rod 71 has its upper end threaded to receive threaded coupler 77 which, in turn, threadably receives a threaded plug member 78, which is secured to the end of motion transmission cable 80, which is coated with a solid lubricant so that it is of low friction in sheath 76. Rod 71 is maintained in accurate coaxial alignment in tube 72 by Delron™ or Teflon™ bushings 81, 82, 83 (FIG. 8*d*) and thus in accurate coaxial alignment with the cable sheath adjuster 75 and the end of cable sheath 76.

The drum mounting bracket 84 is secured to the drum body as described earlier. Freely rotating pulley 8-1' and 8-2' are carried on laterally extending arms 85, 86 and have the ends of tuning cable 7' trained thereover. The ends are secured to motion clamp or block 9' which is translated or moved by virtue of its coupling to the end of motion transmission cable 80. The end of sheath 76 is secured to the lower end of frame 4' (not shown).

While my invention is depicted in FIGS. 1 and 2 with vibrating drumheads on both ends of the drum body, it should be appreciated that it applies also to drums having a drumhead only at one end such as Kettle drums, for example. Though the diagrams show six pulley/connecting cables between two drumheads, my invention does not restrict the number of cables, which might be less than or greater than six. In FIG. 7, there are eight pulley/cable pitch adjusting elements. And, while the drawings show a single tuning cable through simple pulleys, the tuning cable could be arranged to pass over multiple pulleys on each connecting cable so that it passes more than once around the drum and its group of connecting cables. The result of such an arrangement would be increased tuning cable movement, lower force, and a more uniform force on each connecting cable. Moreover, one guide pulley 8-1 or 8-2 could be eliminated and the end of tuning cable 7 anchored or attached to mounting bracket 4.

My invention would also be applicable to a musical instrument in which the connecting elements, instead of forming a cylinder, instead formed a section of a cone. The same principle of reducing the area enclosed by the connecting elements near their centers would operate in exactly the same fashion in such alternative settings.

The tuning element 7, while described in this specification as comprising a cable, may be made from suitable nonmetallic material, especially in instruments of small diameter where a metal cable of convenient diameter would require large pulleys and be excessively too stiff for smooth tuning movement.

What is claimed is:

1. A variable pitch percussion instrument comprising a drum body having an open end with an annular edge and an opposing end, at least one drumhead assembly, including, flexible drumhead material stretched across said annular edge and an annular drumhead mounting ring secured to the perimetrical edges of said flexible drumhead material so that tension can be increased on said flexible drumhead material by pressure between said open end of the drum body and said flexible drumhead material, a plurality of flexible linear connecting elements, each having a pair of ends, means for securing one end of said pair of ends of each said flexible linear elements circumferentially around said mounting ring and the remaining end of said pair of ends, respectively, to said opposing end of said drum body, a flexible tuning element located between the ends of said connecting elements, respectively, and arranged to tangentially engage and circumferentially wrap around said connecting elements such that when the area enclosed by said flexible tuning element is varied, said linear connecting elements apply more or less tension on said flexible drumhead material and change the pitch when said flexible drumhead material is vibrated, including a plurality of friction reducing elements, one for each of said flexible linear connecting elements, respectively, said flexible tuning element tangentially engaging all of said friction reducing elements.

2. The instrument as defined in claim 1 wherein said friction reducing elements are grooved pulleys and said tuning element is fitted into each said grooved pulley, respectively.

3. The instrument defined in claim 2 wherein each of said grooved pulleys has a part fixed to an associated linear connecting element, respectively, and a rotary portion journaled for rotation about said part fixed to its associated linear connecting element, and a flexible tuning element receiving groove in the outer periphery of said rotary portion.

4. A variable pitch percussion instrument comprising a drum body having an open end with an annular edge and an opposing end, at least one drumhead assembly, including, flexible drumhead material stretched across said annular edge and an annular drumhead mounting ring secured to the perimetrical edges of said flexible drumhead material so that tension can be increased on said flexible drumhead material by pressure between said open end of the drum body and said flexible drumhead material, a plurality of flexible linear connecting elements, each having a pair of ends, means for securing one end of said pair of ends of each said flexible linear elements circumferentially around said mounting ring and the remaining end of said pair of ends, respectively, to said opposing end of said drum body, a flexible tuning element located between the ends of said connecting elements, respectively, and arranged to tangentially engage and circumferentially wrap around said flexible linear connecting elements such that when the area enclosed by said flexible tuning element is varied, said flexible linear connecting elements apply more or less tension on said flexible drumhead material and change the pitch when said flexible drumhead material is vibrated, including a foot pedal mechanism and means for coupling said foot pedal to said flexible tuning element.

5. The instrument defined in claim 4 wherein said foot pedal mechanism includes:

a frame, a foot pedal having first and second ends, means for pivotally connecting said first end of said foot pedal to said frame, a motion transmission member having one end secured to said flexible tuning element, and a rigid link member having a pair of ends, one of said pair of ends being connected to said motion transmission member and the other of said pair of ends being pivotally connected to said second end of said foot pedal.

6. The instrument defined in claim 5 wherein said motion transmission member includes a flexible cable portion having first and second ends, said rigid link member being fixedly connected to said first end of said flexible cable, means for maintaining said first end and said first end of said flexible cable in alignment so that there is a smooth and low friction transfer of foot pedal motion to said flexible cable.

7. The instrument defined in claim 6, said maintaining means including a tubular housing member having low friction for supporting said rigid link member and bearing means for maintaining said alignment.

8. A variable pitch percussion instrument comprising a drum body having an open end with an annular edge and an opposing end, at least one drumhead assembly, including, flexible drumhead material stretched across said annular edge and an annular drumhead mounting ring secured to the perimetrical edges of said flexible drumhead material so that tension can be increased on said flexible drumhead material by pressure between said open end of the drum body and said flexible drumhead material, a plurality of flexible linear connecting elements, each having a pair of ends, means for securing one end of said pair of ends of each said flexible linear elements circumferentially around said mounting ring and the other ends of said pair of ends, respectively, to said opposing end of said drum body, a flexible tuning element located between the ends of said connecting elements, respectively, and arranged to tangentially engage and circumferentially wrap around said connecting elements such that when the area enclosed by said flexible tuning element is varied, said connecting elements apply more or less tension on said flexible drumhead material and change the pitch when said flexible drumhead material is vibrated, including a releasable latch means for maintaining said flexible tuning element in a predetermined position of adjustment so that the pitch of said drum is constant.

9. A device for varying the pitch in a drum having a drumhead, a rigid ring and a drum body having an opening and a remote surface area, means clamping said drumhead to said rigid ring in stretched relation over said opening on said drum body, said drum body having an axial center, said device including a plurality of linear tension elements, each said linear tension element having a pair of ends, one of said pair of ends of each linear tension element being secured to said rigid ring in a circumferential pattern, the other of said pair of ends of said linear tension elements being secured to said remote surface area on said drum body, a flexible tuning element tangentially engaging each said linear tension element in a predetermined plane for simultaneously moving the points of tangential engagement towards and away from said axial center to thereby vary the pitch of said drum, including a foot pedal and means for coupling said foot pedal to said tuning member.

10. In a percussion musical instrument having a vibrating surface member having a periphery, a natural frequency and a plurality of linear tension elements connecting circumferential points on said periphery of said vibrating surface to a remote surface area on the instrument, and whose musical pitch can be altered by tensioning said vibrating surface member at one end of the instrument, and a tuning device for altering the tension in said vibrating surface member, the improvement in said tuning device comprising:

a low friction structure mounted on said linear tension elements and in a common plane between the ends of all said tension elements to permit said tension elements to change stress in the vibrating member, a flexible tuning element arranged in said common plane substantially normal to the axes of said plurality of said linear tension elements and engaging said low friction structure of said plurality of linear tension elements to define an area bounded by said flexible tuning element in said common plane, means to alter said area in said plane substantially normal to the axis of said plurality of tension elements, thereby to effect an increase in the tension of the vibrating surface and its natural frequency of vibration.

11. A device for varying the pitch in a drum having a drumhead, a rigid ring and a drum body having an opening, and a remote surface area, means clamping said drumhead to said rigid ring in stretched relation over said opening on said drum body, said drum body having an axial center, said device including a plurality of linear tension elements, each said linear tension element having a pair of ends, one of said ends, each said linear tension element being secured to said rigid ring in a circumferential pattern, the other of said ends of said linear tension elements being secured to said remote surface area on said drum body, a flexible tuning element tangentially engaging each said linear tension element in a predetermined plane for simultaneously moving the points of tangential engagement towards and away from said axial center to thereby vary the pitch of said drum and means on each said linear tension element for collectively establishing said predetermined plane.

* * * * *